US006625943B1

(12) United States Patent
Renner

(10) Patent No.: US 6,625,943 B1
(45) Date of Patent: Sep. 30, 2003

(54) BUILDING INTERIOR CONSTRUCTION SYSTEM AND METHOD

(76) Inventor: Peter S. Renner, 4811 Columbia Rd., Cedarburg, WI (US) 53012

( * ) Notice: Subject to any disclaimer, the term of this patent is extended or adjusted under 35 U.S.C. 154(b) by 19 days.

(21) Appl. No.: 09/794,435

(22) Filed: Feb. 27, 2001

(51) Int. Cl.[7] ..... E04B 1/00

(52) U.S. Cl. ..... 52/251; 52/250; 52/252; 52/425; 52/319

(58) Field of Search ..... 52/250, 251, 252, 52/249, 425, 337, 319, 326

(56) References Cited

U.S. PATENT DOCUMENTS

| | | | | | |
|---|---|---|---|---|---|
| 1,517,244 | A | | 12/1924 | Martin | |
| 1,598,131 | A | | 8/1926 | Ham | |
| 2,037,482 | A | * | 6/1936 | Oliver | 72/1 |
| 2,948,944 | A | | 8/1960 | Graves | 25/131 |
| 4,081,935 | A | * | 4/1978 | Wise | 52/236.8 |
| 5,050,358 | A | * | 9/1991 | Vladislavic | 52/334 |
| 6,247,677 | B1 | * | 6/2001 | Vinet | 249/189 |
| 2001/0003234 | A1 | * | 6/2001 | Van Dorn | 52/251 |

* cited by examiner

*Primary Examiner*—Carl D. Friedman
*Assistant Examiner*—Nahid Amiri
(74) *Attorney, Agent, or Firm*—Boyle Fredrickson Newholm Stein & Gratz S.C.

(57) ABSTRACT

An assembly and method for constructing a building having an interior with a loft style or appearance. The assembly and method of present invention discloses a form assembly that is used to form successive levels on the interior of a building that have a loft style or appearance. The form assembly is constructed of a number of pieces of rigid material which may have a roughened or weathered exterior surface that is exposed when the assembly is constructed. The form assembly is then filled with a cast-in-place concrete which sets and provides support for the interior of the building while also creating an interior which has the loft style appearance.

28 Claims, 9 Drawing Sheets

BUILDING INTERIOR CONSTRUCTION SYSTEM AND METHOD

FIELD OF THE INVENTION

The present invention relates to assemblies and methods for constructing a building, and more particularly to an assembly and method of constructing the interior of a building such that the interior has a loft-style or that can also have a roughened, weathered appearance.

BACKGROUND OF THE INVENTION

For many years, people have desired to live and work in loft-style spaces with high ceilings and tall windows that provide the occupant with an increased amount of space in which to live or work. These types of spaces also offer other highly desirable qualities such as a character-filled, or less sterile environment, exposed wood, possibly with a weathered look, and the overall sense of being in a desirable location, among others.

This style of space is often created by converting an unused industrial buildings into a number of separate living areas, offices or spaces for other uses by renovating the interior of the building. However, due to the fact that most of the buildings which are converted in this manner were built more than 30 years ago, the interiors of these buildings have deteriorated over time. This deterioration greatly complicates conversion of these buildings into loft spaces. The reasons for the difficulty in converting the buildings include problems with complying with applicable building codes, the high and sometimes unpredictable cost of renovating the building, the uncertain structural capabilities of the building and the inability to always obtain proper acoustic separation between the loft spaces.

Furthermore, even without the above-mentioned problems, there are only a limited number of buildings available in desirable areas for conversion to living spaces, such that the demand for these spaces greatly exceeds the supply.

Therefore, it is desirable to provide an assembly and method for constructing an interior for a newly erected building that provides the desired loft-style look.

SUMMARY OF THE INVENTION

It is an object of the invention to provide an assembly and method for constructing an interior of a new building that provides the building interior structure with a loft-style look or appearance without encountering any of the problems associated with the conversion of an existing industrial building.

It is another object of the invention to provide an assembly and method for constructing an interior of a new building in which the various forms utilized in the method and assembly can be prefabricated and transported to the construction site for use in constructing the building structure.

It is still another object of the invention to provide an assembly and method in which the forms used in the method and system can be constructed of any material which can also include a weathered or roughened exterior, if desired.

It is still a further object of the invention to provide an assembly and method in which the building interior structure can be constructed from cast-in-place concrete.

It is still another object of the invention to provide an assembly and method in which the forms can be adapted to any building interior structure configuration required by the particular building in which the method and system are applied.

The present invention is an assembly and method for constructing a building interior in order to provide the interior with a loft-style look or appearance. The system includes a number of prefabricated forms which are assembled into a form assembly over an area of ground, a floor, a ceiling or similar horizontal surface between the exterior sidewalls of the building. The form assembly is created from a number of pieces of a generally rigid material that can have a roughened or weathered exposed surface visible on each form in the assembly. The forms are positioned within the interior of the building to form the supporting structure for the building interior, such as columns and beams.

After the form assembly is positioned within the building interior, a number of prefabricated decking panels can be attached between the various support beams in order to provide a ceiling and floor or roof for the building interior. The panels are formed of a material similar to that which the forms are made, and can also include a roughened exposed surface on one side of the panel. The exposed surface faces downwardly towards the horizontal surface on which the forms rest to insure that the roughened surface is-exposed when the building interior is finished. The decking panels are then secured to the forms in such a manner as to leave the interiors of the support beams and the columns exposed.

After the panels, support beams and columns secured to one another, cast-in-place concrete may then be poured onto the forms. The concrete flows over the panels and fills the columns and support beams, and also forms a concrete slab having a desired thickness over each panel. Once the concrete has set and reached the necessary degree of hardness, another assembly of forms can be positioned on the concrete slab formed over the panels in order to form an interior structure for the next floor of the building.

Various other features, objects and advantages of the invention will be made apparent from the following detailed description taken together with the drawings.

BRIEF DESCRIPTION OF THE DRAWINGS

In the drawings.

The drawings currently illustrate the best mode contemplated of practicing the present invention.

DETAILED DESCRIPTION OF THE INVENTION

Figure 1:
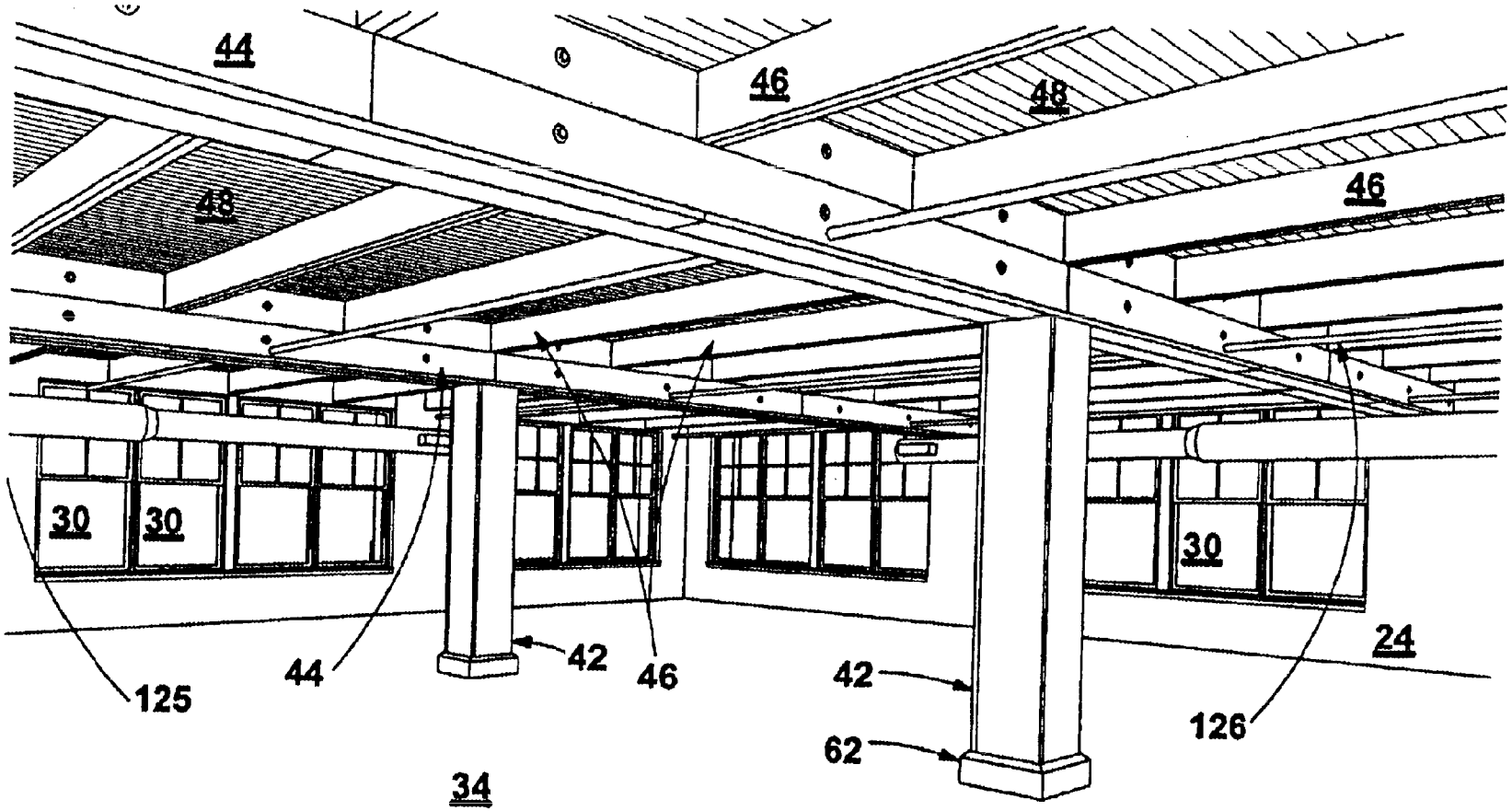
FIG. 1 is a perspective view of a building interior constructed using the assembly and according to the method of the present invention.

Referring now to the drawing figures in which like reference numerals designate like parts throughout the disclosure, a building having an interior constructed using the system and according to the method of the present invention is designated generally at 20 in FIG. 1. The building 20 is formed with a reinforced concrete structural slab 22, a plurality of sidewalls 24 extending upwardly from each side of the structural slab 22, and a roof 26 extending between and optionally over the sidewalls 24 opposite the slab 22. The sidewalls 24 also include a door or other entranceway 28, and a plurality of windows 30.

Figures 3, 4:
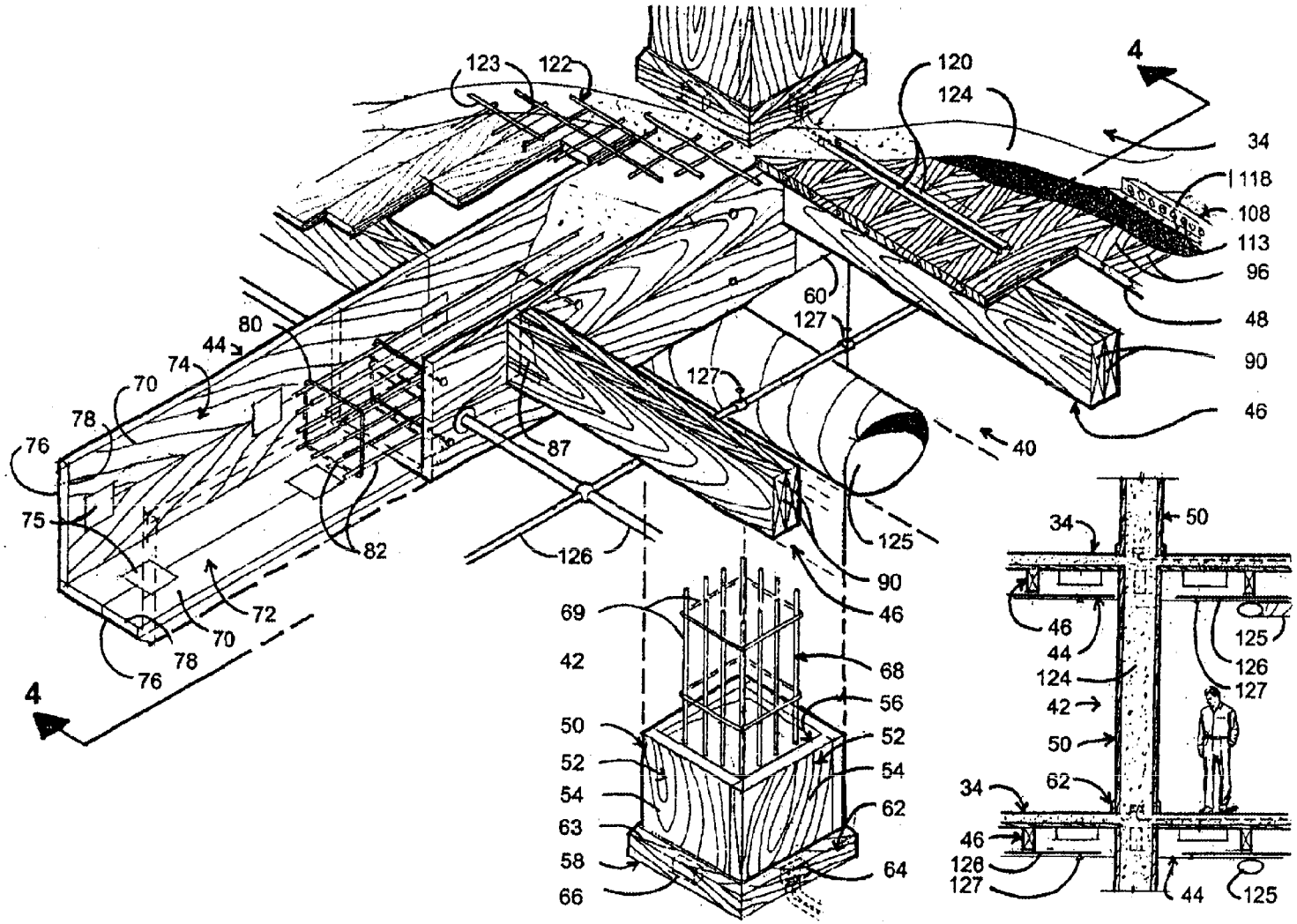
FIG. 3 is a cross-sectional view of a building having an interior constructed using the assembly and according to the method of the present invention.
FIG. 4 is a cross-sectional view along line 4—4 of FIG. 3.

As best shown in FIG. 3, the interior of the building is divided into a plurality of levels 32 by a number of horizontal surfaces 34 extending across the interior of the building 20 between the sidewalls 24. Each surface 34 provides a ceiling for each level 32 beneath the surface 34, and a floor for the level 32 above the surface 34.

Figure 2:
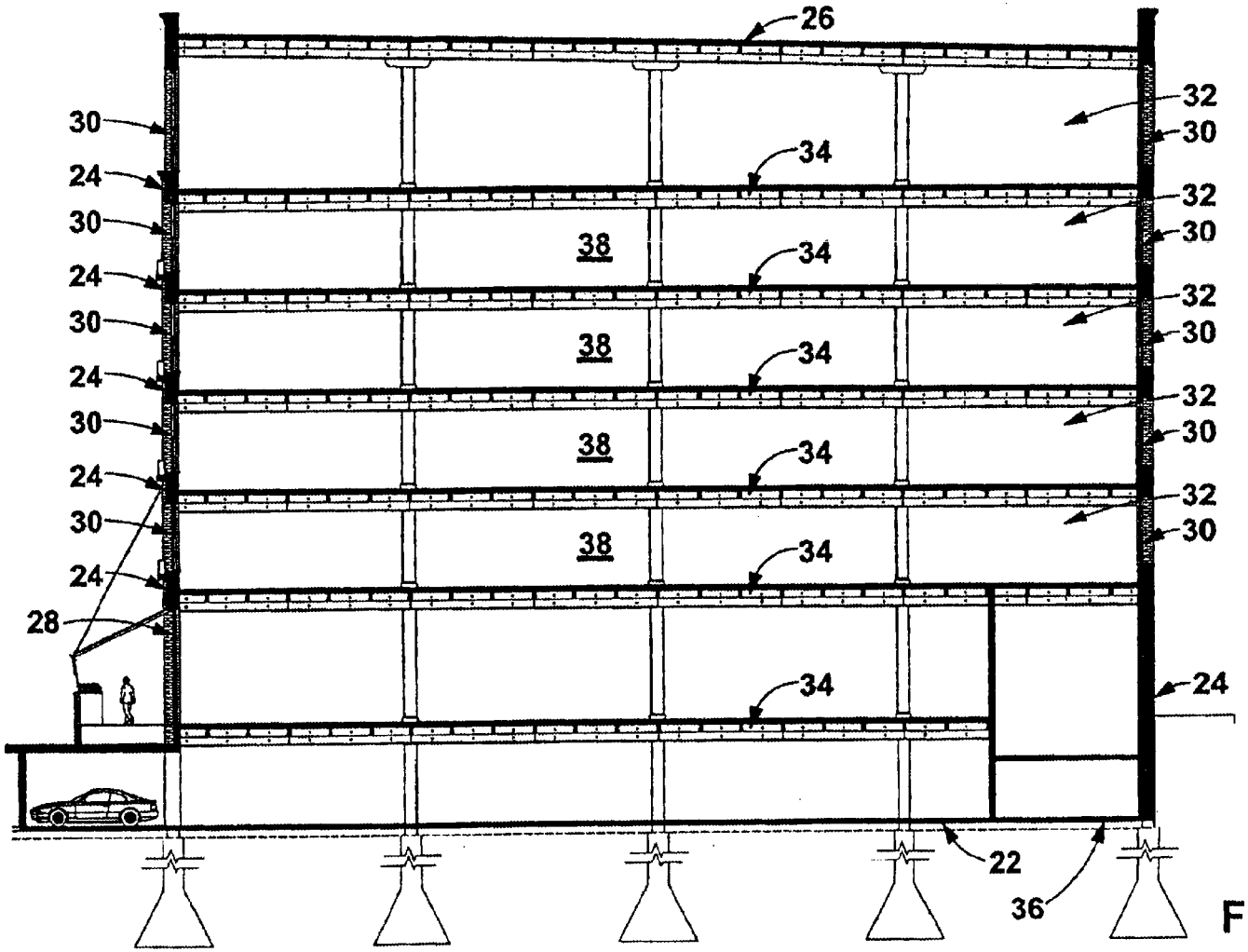
FIG. 2 is a partially broken away view of the building interior of FIG. 1.

Referring now to FIG. 2, to erect the building 20, initially the slab 22 is poured over the section of ground 36 on which the building 20 is to be constructed. After the slab 22 is finished, the sidewalls 24 can be erected on each side of the slab 22. Both the slab 22 and sidewalls 24 can be formed in a conventional manner, such as by pouring concrete into forms for the slab 22 and sidewalls 24. Once the sidewalls 24 have been formed, the interior 38 of the building 20 can be constructed using the assembly and method of the present invention.

Referring now to FIG. 2, a concrete form assembly 40 is illustrated. The assembly 40 includes a column 42, a support beam 44, a number of purlins 46 and a number of surface panels 48.

Figure 10:
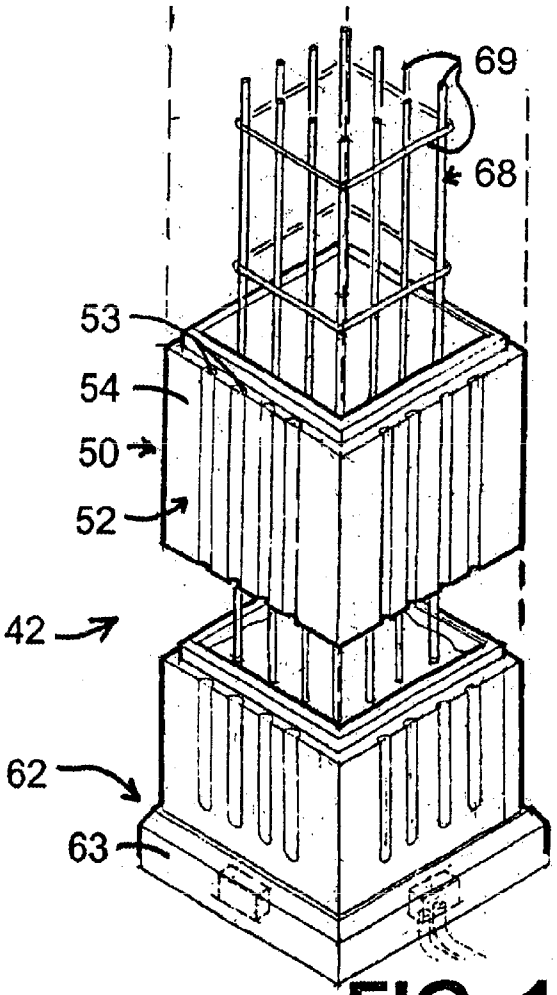
FIG. 10 is a partial isometric view of a third embodiment of the forms used in the assembly for the column of FIG. 2.
Figure 9:
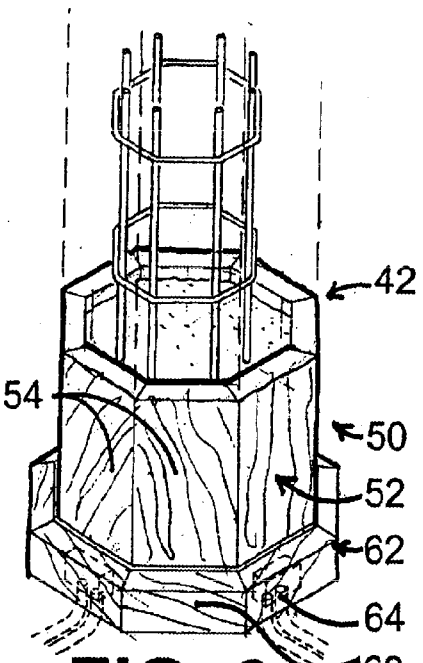
FIG. 9 is a partial isometric view of a second embodiment of the forms used in the assembly for the column of FIG. 2.

The column 42 is constructed using one or more column forms 50 that each include a number of individual pieces 52 formed of a rigid material secured to one another. Materials suitable for use in the pieces 52 include concrete, wood, metal or any other suitable rigid material, with wood being the preferred material. The pieces 52 are secured to one another using any conventional means, such as a nail, screw, securing plate or industrial adhesive, and can be configured to form the desired shape, such as an octagon shown in FIG. 9, or design, such as including decorative grooves 53 on the exterior of each piece 52 as shown in FIG. 10, for the column 42. Each piece 52 includes an exterior surface 54 which forms the outside of the column form 50 and an interior surface 56. The pieces 52 are assembled into the column form 50 such that the interior surface 56 of each piece 52 faces inwardly towards the remaining pieces 52 and the exterior surface 54 is exposed. The pieces 52 of the column form 50 can have a length equal to the distance between adjacent surfaces 34 in the interior 38 of the building 20, or can be formed of smaller sections which are vertically assembled in order to complete the column form 50. The exterior surfaces 54 on the pieces 52 can also be roughened if desired to provide a weathered appearance to the column 42.

The form 50 extends from a lower end 58 positioned on a surface 34 disposed beneath the assembly 40, to an upper end 60 opposite the lower end 58. The lower end 58 can also include a border 62 which encircles the lower end 58 to expand the width of the column form 50. The border 62 is formed of one or more sections 63 of a material similar to that used to form the pieces 52 and has a width sufficient to enclose and retain electrical outlets 64 and telecommunication connections 66 which extend upwardly from the surface 34 directly below the column 42. The sections 63 can be hollow to more easily enclose the outlets 64 and may also include roughened, exterior surfaces that are exposed to enhance a desired weathered appearance for the column 42.

When completely assembled, the column form 50 is shaped as a hollow, generally square conduit extending upwardly from the surface 34 the length of the column 50. To enhance the stability of the column 50, a reinforcing member 68 can be disposed within the column form 50. The reinforcing member 68 preferably comprises a cage formed from steel rods or rebar 69 of the type normally used in building construction. The rods 69 extend upwardly above the upper end 60 of the column form 50 such that they can interconnect with a second column form 50 and reinforcing member 68 positioned above the first form 50. The reinforcing member 68 also conforms to the shape, of the column 42 and provides additional strength to the columns 42.

Once the column form 50 is completely assembled, the support beam 44 can be formed and attached to the upper end 60 of the column form 50. The support beam 44 includes a number of elongate boards 70 secured to one another in a generally U-shaped configuration to define a bottom 72 and a pair of upwardly extending sides 74 on either side of the bottom 72. The boards 70 are joined to one another by any suitable connecting means, such as nails, screws, industrial adhesives or nail plates 75. Once the beams 44 are assembled, the beams are positioned and secured to opposite sides of the upper end 60 of the column form 50 to support one end of the beam 44. Opposite the column form 50, each of the support beams 44 is secured to a second column form 50 or to an attachment structure (not shown) secured to the interior surface of an adjacent sidewall 24. The attachment structure normally comprises a wall formed of poured concrete or concrete block, a steel column or the like. Each beam 44 is supported at specified intervals between each end of the beam 44 by a number of temporary supporting members or reshores (not shown) extending between the bottom 72 of each beam 44 and the surface 34 beneath the assembly 40.

Each of the boards 70 is formed of a material similar to that used for the pieces 52 of the column form 50 with an exterior surface 76 and an interior surface 78. When used to form the support beams 44, the boards 70 are positioned such that the exterior surface 76 of each board 70 faces outwardly from the rest of the boards 70 forming the beam 44. The exposed exterior surface 76 may also be roughened, if desired.

Once the beams 44 are attached to the column forms 50 and sidewalls 24, and are supported by the reshores, one or more reinforcing members 80 are placed within the interior of each support beam 44. The reinforcing members 80 are formed of metal rods 81 similarly to the reinforcing members 68 positioned within the column form 50 and serve to enhance the strength and rigidity of the beams 44 when the assembly 40 is completed.

After the reinforcing members 80 are positioned within the support beams 44, a number of bolts 82 are inserted through the beams 44 and members 80 to hold the sides 74 of the beam 44 to one another and to support the reinforcing member 80 within the beam 44. The bolts 82 are spaced at regular intervals along the beam 40 to provide a constant amount of support for the beam 44 and reinforcing member 80 along the respective lengths.

Figure 13:
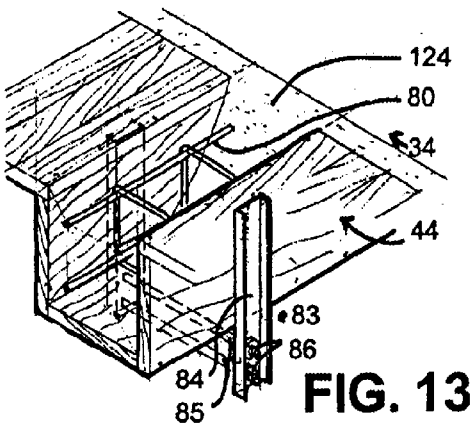
FIG. 13 is a partial isometric view of a temporary clamp used to secure a portion of the assembly of FIG. 2.

Alternatively, if it is desired to form beams 44 without any bolts 82 protruding from the sides 74 of the beams 44, the beams 44 can be held together by a releasable clamp 83 as shown in FIG. 13. The clamp 83 includes a pair of clamping sections 84 positioned against sides 74 of the beam 44. The sections 84 are held in place by bolts 85 secured between the sections 84 beneath the bottom 72 by nuts 86. Once the assembly 40, including the beams 44, is completed, the nuts 86 can be loosened and the clamp 83 removed from the beam 44. The clamps 83 can also be used to hold other parts of the assembly 40 together during the pouring of the concrete 124, such as the column forms 50 and the purlins 46.

After the beams 44 have been assembled and secured, a number of purlins 46 are secured between the adjacent beams 44. The purlins 46 are spaced from one another and from the column forms 50 an appropriate distance to allow the purlins 46 to provide constant support for the entire assembly 40. Each purlin 46 is formed of a material similar to the beams 44 and columns 42, can have a roughened exterior that aids in producing the weathered appearance for the building interior 38. The purlins 46 may be formed of a pair of planks 90 secured in a side-by-side relation to one another, or may consist of a single, thicker plank 91 similar in shape to planks 90 extending between the beams 44.

Figure 12:
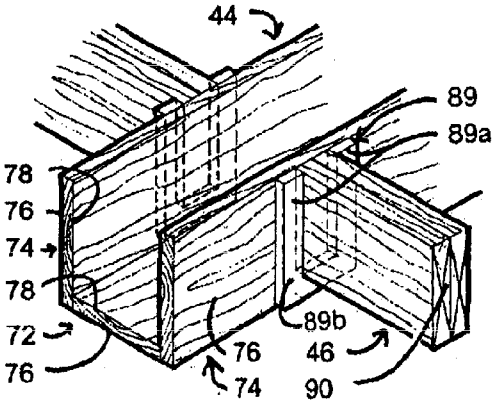
FIG. 12 is a partial isometric view of a third embodiment for the attachment of a purlin to the assembly of FIG. 2.
Figure 11:
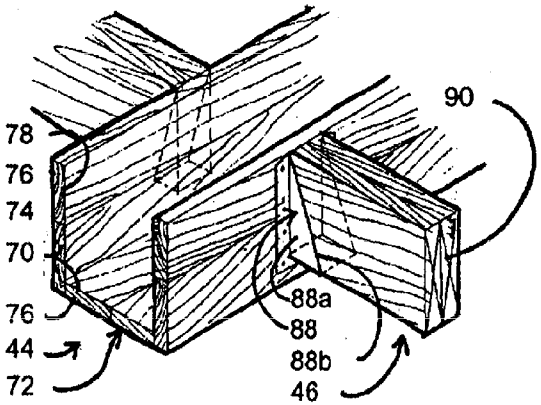
FIG. 11 is a partial isometric view of a second embodiment for the attachment of a purlin in the assembly of FIG. 2.

The purlins 46 are secured between the respective beams 44 by a concealed joist hanger 87, shown in FIG. 3, an exposed joist hanger 88, shown in FIG. 11, or a saddle 89, shown in FIG. 12, that is attached to the beam 44 and the purlin 46. The hanger 87 is formed as an angled panel that is secured between two boards 70 forming a side 74 of the beam 44 and sits between the planks 90 forming the purlin 46. The hanger 88 and saddle 89 are generally U-shaped and include side walls 88*a* and 89*a*, and bottom walls 88*b* and 89*b*, respectively. The hanger 88 and saddle 89 are secured by conventional means to the sides 74 of the beam 44 and the purlin 46 is slidably received within either the hanger 88 or the saddle 89 to hold the purlin 46 on the beam 44. Each of the hangers 87 and 88 and the saddle 89 is formed of a material similar to that used in the purlins 46, with metal being preferred for the hangers 87 and 88, and wood being preferred for the saddle 89. Further, if desired the exposed surfaces of the saddle 89 can be roughened to aid in providing a roughened appearance for the interior 38.

Figure 5:
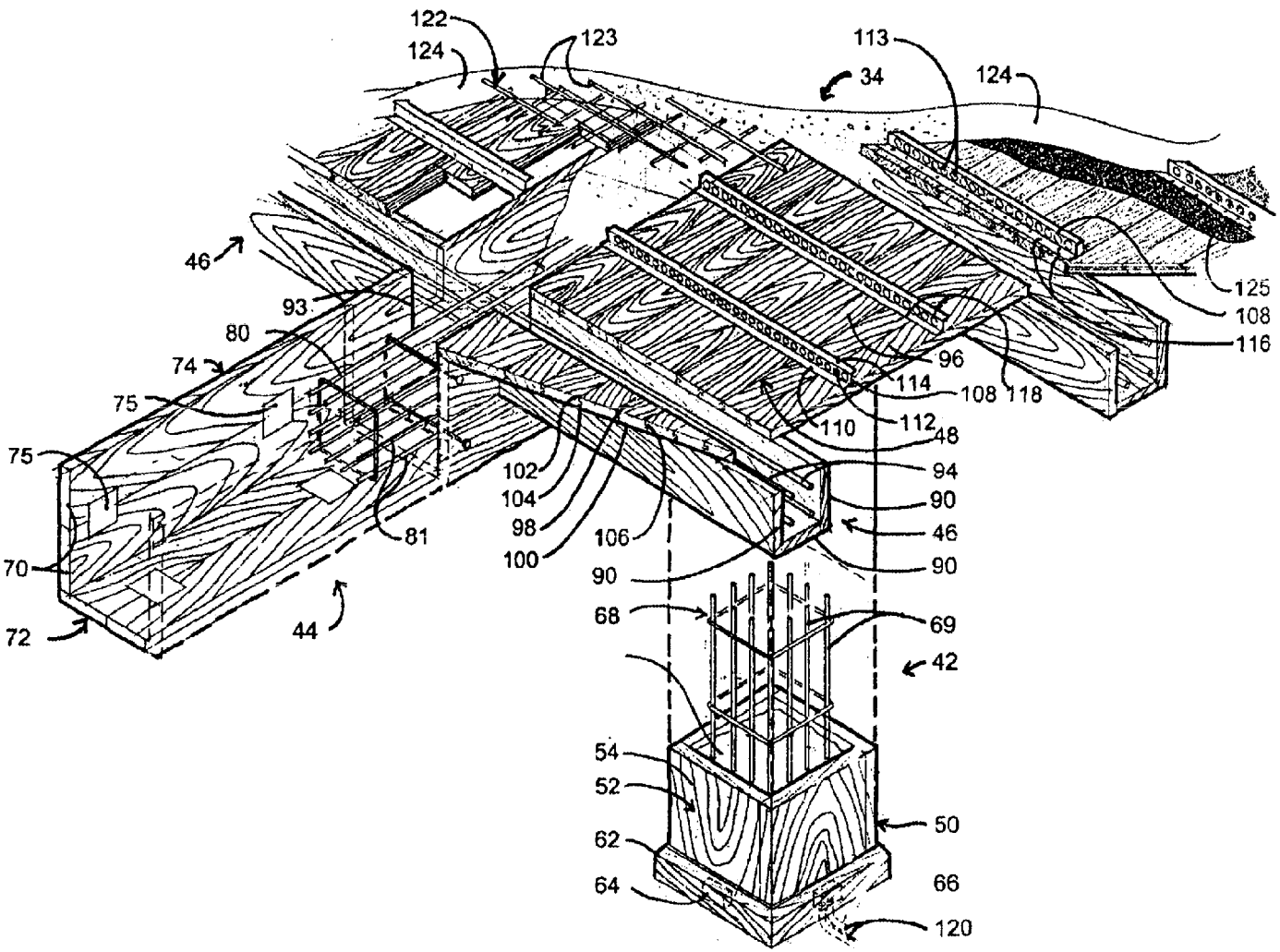
FIG. 5 is a partially broken away perspective view of a second embodiment of the assembly of FIG. 2.

As shown in FIG. 5, the purlin 46 may also comprise an arrangement 92 of planks 90 similar in shape to the support beams 44 in which each purlin 46 includes three planks 90 joined to one another using conventional means in a U-shaped configuration. In this embodiment, each plank 90 is secured at each end within a slot 93 defined in a side 74 of the beam 44. This arrangement supports each purlin 46 and enables a number of reinforcing rods 94 to be inserted into aligned purlins 46 through the perpendicular beams 44 in order to provide additional support to the purlins 46 and assembly 40.

After the purlins 46 have been secured between the support beams 44, a number of surface decking panels 48 can be attached to the beams 44 and purlins 46 above the column 42 using conventional means. The panels 48 are formed of a number of interlocked planks 96 formed of a material that can be similar to that used in forming the columns 42, beams 44 and purlins 46. Each plank 96 has an upper surface 98, a an exposed lower surface 100, a side surface 102 containing a groove 104 at one end, and a side surface 102 containing a tongue 106 at the opposite end. The respective planks 96 are connected to one another to form the panels 48 by the insertion of a tongue 106 on one plank 96 into the groove 104 on the adjacent plank 96. The engagement of the groove 104 and tongue 106 can be enhanced by the use of a connecting means such as an adhesive, a nail or a screw. If desired, the lower surface 100 can also be roughened to provide a weathered appearance to the building,. interior 38.

The planks 96 are also held in engagement with one another by the use of a rail 108 extending across each panel 48 perpendicular to the planks 96. Each rail 108 includes a lower flat portion 110, an upwardly extending central portion 112 including spaced openings 113, and an upper flat portion 114 that extends in a direction opposite the lower portion 110. The lower portion 110 of the rail 108 is secured to each plank 96 using a conventional securing means such as a nail or screw that, when driven through an opening 116 in the lower portion 110, penetrates into the plank 96 disposed directly beneath the rail 108.

After being secured on the panels 48, the a number of conduits 120 are positioned on the upper surface 98 or on the lower surface 100 of the panels 48. The conduits 120 can terminate in an electrical outlet 64 or telecommunication connection 66 that can be disposed over, below or within the surface 34 formed above the rails 108 as desired. Furthermore, other items can be positioned over the panels 48 prior to pouring the concrete 124, such as heating coils.

When the panels 48 are secured to the beams 44 and the purlins 46, each of the panels 48 covers the area between the column forms 50 and beams 44, but leaves the upper end 60 of each column form 50 and each support beam 44 exposed. Each purlin 46 is also exposed if the assembly 40 is formed similarly to the embodiment of FIG. 5.

A reinforcing structure 122 is then placed on the panels 48 over the rails 108. The structure 122 is a generally rectangular grid of metal rods or rebar 123. The structure 122 enhances the strength and rigidity of the concrete 124 that is to be poured over the assembly 40 to complete the level 32 and form the surface 34.

After the panels 48 are secured to the purlins 46 and the structure 122 is positioned over the panels 48, the assembly 40 is ready to receive liquid cast-in-place concrete 124. The concrete 124 is poured over the panels 48 and flows into the open ends of the support beams 44 and the column form 50. The concrete 124 completely fills the column form 50 and the support beam 44 and forms a layer approximately four to twelve inches thick over the panels 48. The concrete 124 then dries and sets around the reinforcing members 68 within the column form 50, the reinforcing member 80 and bolts 82 within the support beam 44, and around and through the rails 108 and reinforcing structure 122 on each panel 48. The engagement of the concrete 124 with the rails 108 keeps the panels 48 in engagement with the concrete 124. In order to prevent seepage of any moisture from the concrete through the panels 48, it is also possible to place a waterproof membrane 131 or apply a waterproofing spray over the panels 48 prior to the placement of the rails 108 on the panels 48 in order to separate the concrete 124 completely from the panels 48.

Once the concrete 124 has set, the reshores and clamps 83 can be removed from each column 42, support beam 44 and purlin 46 in order to provide a living or office space in which the assembly 40 presents a loft-style appearance to the interior 38 of the space or level 32. Once the assembly 40 has reached sufficient strength, an assembly 40 for creating the interior structure 38 for the next successive level 32 may then be constructed on the surface 34 formed by the set concrete 124 over the panels 48 of the completed level 32 in alignment with the completed assembly 40. The resulting structure has a class A fire rating and provides very good acoustic isolation from adjacent levels 32.

After a sufficient amount of time has elapsed for the concrete 124 to reach its optimal strength, the assembly 40 and set concrete 124 filling the assembly 40 may then be drilled to provide openings (not shown) through which pipes 126 for sprinklers 127 can be inserted. Also, ventilation shafts 125 can be supported beneath the assembly 40 by securing the shafts 125 to the beams 44, purlins 46 and/or panels 48 of the assembly 40.

Figure 6:
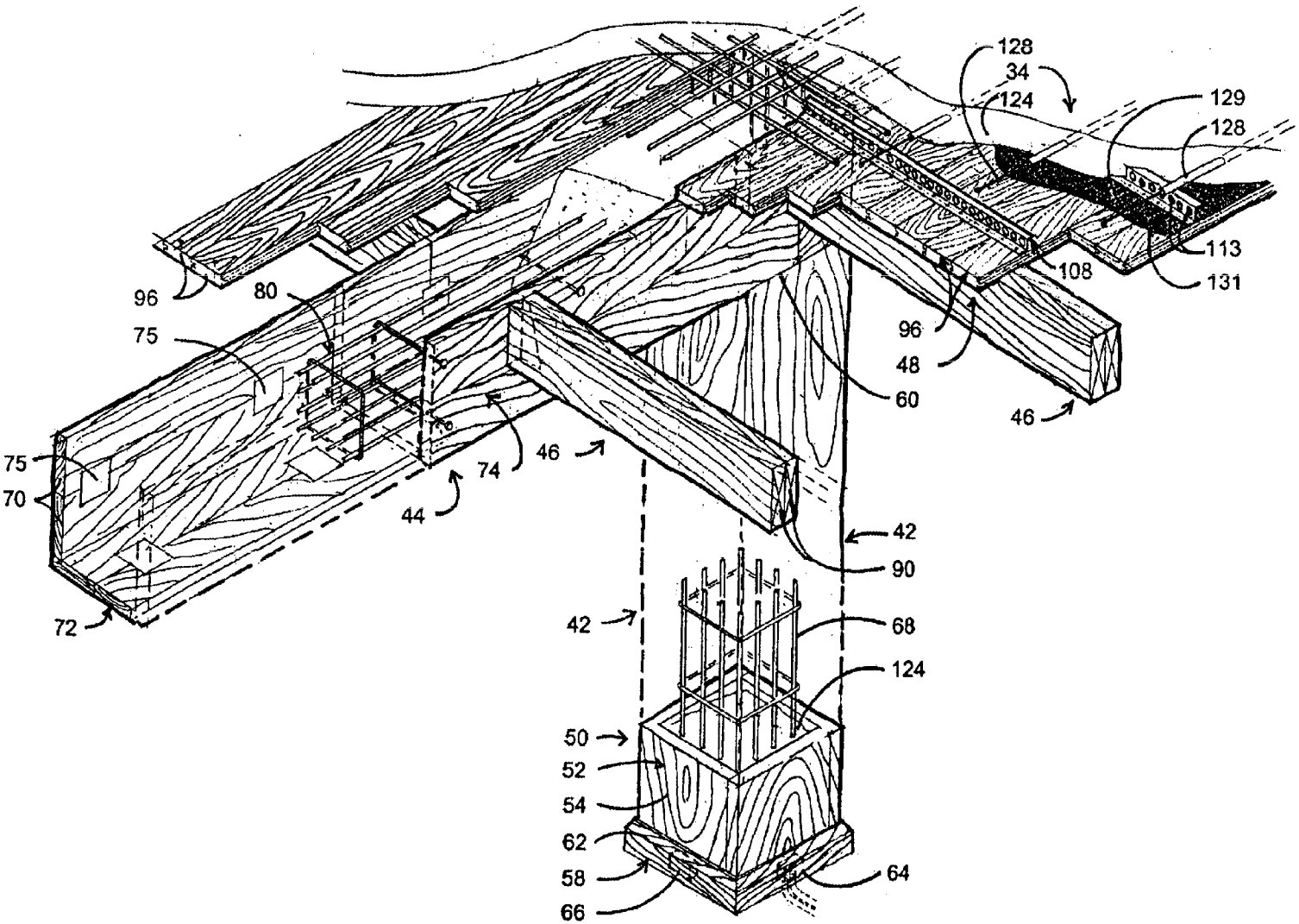
FIG. 6 is a partially broken away isometric view of a third embodiment of the assembly of FIG. 2.

The assembly 40 can also have a number of alternative configurations in order to accommodate the specific requirements for the building 20. For example, as shown in FIG. 6, in building constructions where the surface 34 of each level 32 is to be post-tensioned, the assembly 40 is constructed similarly to that shown in FIG. 3. A number of tubes 128 are then positioned on the rails 108 over the planks 96 forming the panels 48. The tubes 128 are placed over the planks 96 in a grid pattern and extend in a direction parallel to the planks 96 from one end of the interior 38 to the other, and also perpendicularly to the planks 96 between the opposite ends of the interior 38. Each of the tubes 128 encloses a cable or tendon 129 that extends the length of the tube 128. While the tubes 128 are spaced evenly across the panel 48 between the support beams 44 and columns 42, the tubes 128 are more highly concentrated over the support beams 44 and along lines perpendicular to the support beams 44 that extend directly over the columns 42. This configuration is necessary to provide additional support for the beams 44 and columns 42.

When the concrete 124 is poured over the panels 48, the concrete 124 forms the surface 34 above the panel 48 and tubes 128, and flows into and fills the columns 42 and the support beams 44. After the concrete 124 achieves adequate structural strength, the tendons 129 within each tube 128 are tensioned at opposite ends in order to provide additional support to the surface 34 such that the surface 34 can support a much greater amount of weight than would be possible with the concrete 124 alone. After the tendons 129 are sufficiently tensioned, the next assembly 40 can be assembled on the surface 34 above the completed assembly to begin construction of the next level 32.

Figures 7, 8:
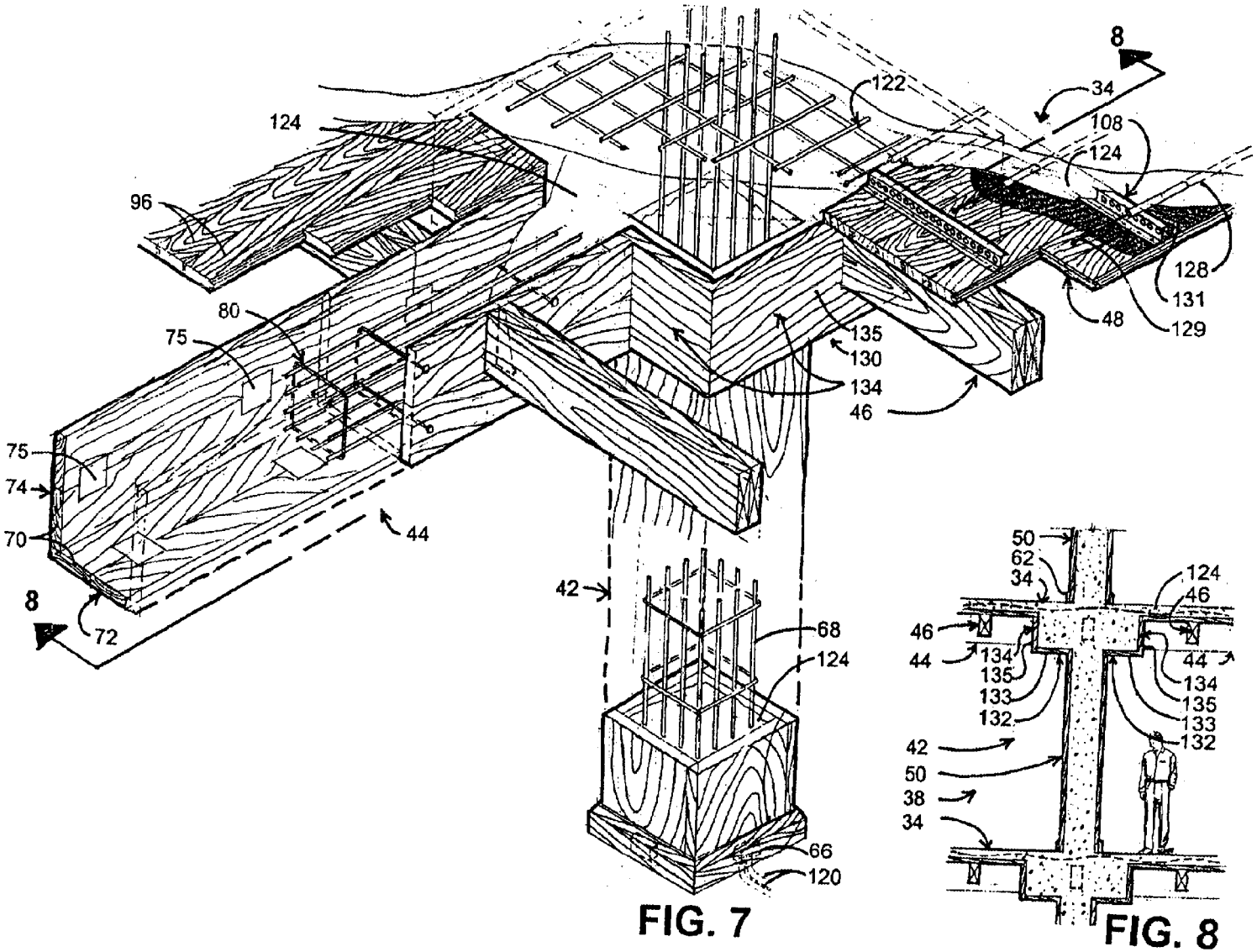
FIG. 7 is a partially broken away isometric view of a fourth embodiment of the assembly of FIG. 2.
FIG. 8 is a cross-sectional view along line 8—8 of FIG. 7.
Figure 7A:
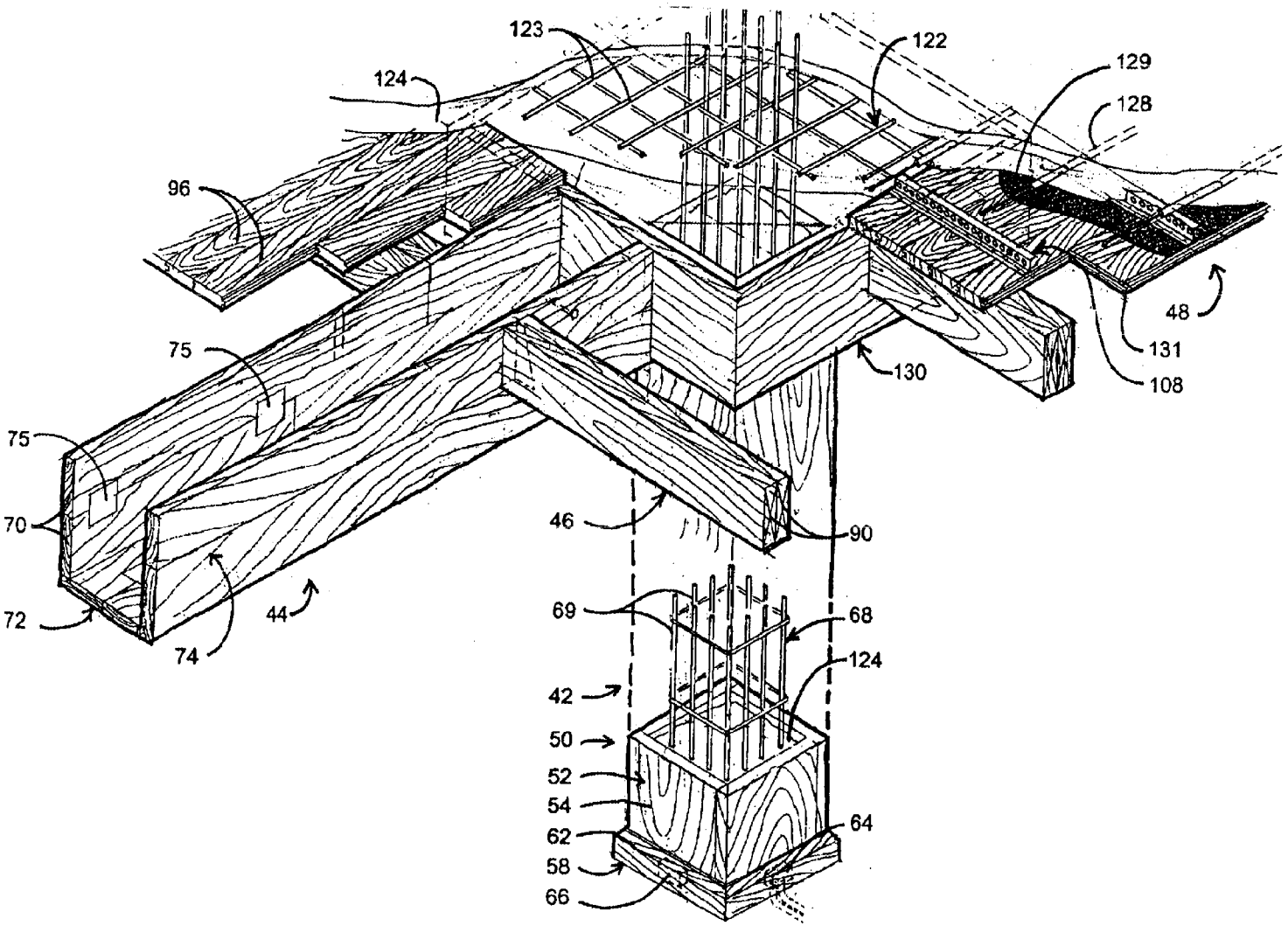
FIG. 7*a* is a partially broken away isometric view of a fifth embodiment of the assembly of FIG. 2.

Still another embodiment of the assembly 40 of the present invention is disclosed in FIGS. 7 and 8. In this embodiment, the upper end 60 of the column form 50 includes a column cap 130. The cap 130 is formed of a material similar to that used to form the column form 50. The cap 130 is also generally rectangular in shape and includes a bottom wall 132 and a number of sidewalls 134 extending upwardly from each end of the bottom wall. The exterior surface 133 of the bottom wall 132 and exterior surfaces 135 of the sidewalls 134 may also have a roughened appearance, if desired. The bottom wall 132 also includes a central opening 136 into which the upper end 60 of the column form 50 is inserted and secured by conventional means. The support beams 44 and purlins 46 are then assembled and secured to the cap 130 and to one another, as described previously. A reinforcing structure 122 can then be positioned within the cap 130 to enhance the strength of the cap 130. Once the support beams 44 and purlins 46 are secured to the column caps 130, the rails 108 are attached to the planks 96 to form the panels 48 which are secured to the assembly 40, leaving the column cap 130, column form 50 and beam 44 exposed. The tubes 128 and tendons 129 are then positioned on the rails 108 over the panels 48. The concrete 124 is then poured onto the assembly 40, such that the concrete 124 flows downwardly into the beam 44, column form 50 and column cap 130 and forms a layer of concrete 124 approximately four to twelve inches above the planks 96. As shown in FIG. 7, after the concrete 124 has set, the tendons 129 are tensioned and the assembly 40 for the next level 32 can be positioned on the surface 34 formed by the set concrete 124 in order to create the interior structure 38 for the next level 32. The use of the cap 130 and post-tensioning tubes 128 and tendons 129 also enables the assembly 40 to be constructed without the need for a reinforcing structure 80 in beam 44, as shown in FIG. 7*a*.

The assembly and method of the present invention also allows for many modifications to be made by an individual using the assembly. For example, the pieces forming the columns 42, beams 44, purlins 46 and panels 48 can all assembled off-site and transported to the construction site for use in constructing the building 20. Also, the assembly 40 can omit one or more of the columns 42, beams 44 or purlins 46 depending upon the type of building and/or interior being constructed. For example, for a smaller building the interior 38 can be constructed using a form assembly 40 having only a column 42 and a number of panels 48 secured to the side walls 24 and the column 42. Alternatively, the form assembly 40 could be constructed of a number of beams 44 secured between the side wall 24 and panels 48 connected between beams 44 without any columns 42 or purlins 46.

Various alternatives and modifications are contemplated as being within the scope of the following claims particularly pointing out and distinctly claiming the subject matter regarded as the invention.

I claim:

1. A method for the construction of the interior of a cast-in-place concrete building to form a building interior having a loft style or appearance, the method comprising the steps of:

a) providing a number of pieces of material with a desired exposed surface;

b) assembling portions of at least one form assembly from the pieces of material using a securing means;

c) supporting the at least one form assembly within the building by connecting the portions to one another using the securing means;

d) placing at least one reinforcing member in the at least one form assembly;

e) pouring concrete into the at least one form assembly;

f) allowing the concrete to set within the at least one form assembly; and g) leaving the at least one form assembly in place around the concrete within the building interior.

2. The method of claim 1 wherein the form assembly is placed on a surface within the building.

3. The method of claim 2 wherein the form assembly defines a hollow, generally vertical column.

4. The method of claim 3 wherein the form assembly further defines at least one generally horizontal first support beam connected to the column.

5. The method of claim 4 wherein the first support beam is hollow.

6. The method of claim 4 wherein the form assembly further defines at least one generally horizontal second support beam connected to the at least one first support beam.

7. The method of claim 6 wherein the second support beam is hollow.

8. The method of claim 6 wherein the form assembly further defines a support surface connected to the at least one first support and the at least one second support.

9. The method of claim 8 wherein the support surface does not cover the column.

10. The method of claim 9 wherein the support surface does not cover the first support bearn.

11. The method of claim 10 wherein the support surface does not cover the second support beam.

12. The method of claim 3 further comprising the step of placing the at least one reinforcing member within the column.

13. The method of claim 2 wherein the desired exposed surface is a roughened, weathered surface.

14. The method of claim 1 wherein the material pieces are formed of wood.

15. The method of claim 2 wherein the pieces of the form assembly are assembled by conventional means.

16. An assembly for constructing the interior of a cast-in-place concrete building to have a loft-style appearance, the assembly comprising:

at least one generally vertical column form constructed of a number of separate pieces and having a lower end and an upper end;

at least one generally horizontal first support beam constructed of a number of separate pieces and secured to the upper end of the column form and to the building, and an at least one support panel constructed of a number of separate pieces and secured to the at least one column form, the at least one first support beam and the building, wherein the separate pieces are pieces of a rigid material that are secured to one another by a securing means to form the at least one generally vertical column form, the at least one generally horizontal first support beam and the at least one support panel, and wherein the rigid material is wood.

17. The assembly of claim 16 further comprising at least one generally horizontal second support beam secured to the first support beam and wherein the at least one support panel is secured to the at least one first support beam, the at least one second support beam and the building.

18. The assembly of claim 16 further comprising a first reinforcing member positioned within the at least one column form.

19. The assembly of claim 16 wherein the at least one first support beam is hollow.

20. The assembly of claim 19 further comprising a second reinforcing member positioned within the at least one first support beam.

21. The assembly of claim 17 wherein the at least one second support beam is hollow.

22. The assembly of claim 17 further comprising a third reinforcing member positioned within the at least one second support beam.

23. The assembly of claim 16 further comprising a cap secured to the upper end of the column and to the at least one support panel.

24. The assembly of claim 16 further comprising a reinforcing structure positioned on the at least one support panel.

25. The assembly of claim 24 wherein the reinforcing structure is rebar.

26. The assembly of claim 24 wherein the reinforcing structure is a number of post-tension tubes and tendons.

27. The assembly of claim 16 wherein the rigid material has a roughened exposed surface.

28. The method of claim 1 wherein the step of supporting the at least one form assembly within the building comprises the steps of:

a) attaching the securing means to the interior of one portion; and b) attaching the securing means to the interior of another portion.

* * * * *